United States Patent [19]

Macioch

[11] Patent Number: 4,544,620

[45] Date of Patent: Oct. 1, 1985

[54] TANNABLE MULTI-COLORED MATERIAL

[75] Inventor: Michael T. Macioch, Baldwin, Wis.

[73] Assignee: Minnesota Mining and Manufacturing Company, St. Paul, Minn.

[21] Appl. No.: 614,296

[22] Filed: May 25, 1984

[51] Int. Cl.[4] ..... G03C 1/06; G03C 7/10

[52] U.S. Cl. ..... 430/264; 430/364; 430/375; 430/405; 430/430; 430/559; 430/563

[58] Field of Search ..... 430/264, 510, 541, 524, 430/559, 302, 563, 309, 405, 306, 430, 357, 364, 375

[56] References Cited

U.S. PATENT DOCUMENTS

| | | | |
|---|---|---|---|
| 4,047,956 | 9/1977 | Blake | 430/502 |
| 4,363,864 | 12/1982 | Rutledge | 430/202 |
| 4,390,612 | 6/1983 | Rutledge | 430/264 |
| 4,427,757 | 1/1984 | Beebe et al. | 430/264 |

*Primary Examiner*—Mary F. Downey

*Attorney, Agent, or Firm*—Donald M. Sell; James A. Smith; Lorraine R. Sherman

[57] ABSTRACT

A photographic element for use in a method of multicolor image formation by tanning development is a layered structure comprising an optionally primed base support, a layer of colloidal silver, a layer of sensitized silver halide emulsion in gelatin free of hardener, and at least one colored pigment or dye dispersed therein which absorbs radiation.

21 Claims, No Drawings

TANNABLE MULTI-COLORED MATERIAL

DESCRIPTION

1. Technical Field

This invention relates to an improved silver halide photographic element for use in a method of multicolor image formation by tanning development. In another aspect, it relates to a method of obtaining positive or negative multi-color images having a reflection or transmission optical density in the range of 1.0 to 5.0 for opaque, translucent, and transparent base supports.

2. Background Art

It is known in the art that image formation methods using tanning development are based on the fact that in the presence of exposed silver halide, certain compounds, known as tanning developers, oxidize in an alkaline environment to give gelatin hardening compounds. The unexposed regions of the image, being unhardened, can be washed away with warm water. It is thus possible, with the known methods of the art, to obtain relief images of gelatin.

Most of these methods produce a black image or a single color such as is disclosed in U.S. Pat. No. 4,427,757. A disadvantage of this sytem is that for a multicolored artwork original, two or more individual colored sheets of material would have to be processed, overlayed and/or laminated in register.

DISCLOSURE OF THE INVENTION

The present invention provides a single or multi-layered, positive- or negative-acting tannable silver halide photographic element capable of producing an image of two or more colors on a single coated sheet. The photographic element is coated on an individual support base and is capable of producing a single colored image with the capability of producing in selected areas at least one additional colored image. Further treatment such as chemical bleaching, either in selected areas or over the entire image, can provide multi-colored or different colored artwork.

It has been found that constructions comprising a primed base support which is coated, in either order (or combined in a single layer), with a light-sensitive silver halide layer and a layer having colloidal silver therein, either or both of the silver-containing layers having at least one colored pigment or dye (i.e., not including carbon black) therein, provides a colored image with a reflection or transmission optical density of at least 1.0 in the UV and/or visible wavelengths. The pigments and/or dyes are dispersed in whole or in part in a properly sensitized silver halide emulsion using gelatin substantially free of hardener and, optionally, having a tanning developer therein. Some or all of the colloidal silver and/or pigments and/or dyes can be in a layer adjacent to the light-sensitive layer. A tanning developer may be present in one or more of any layers present. Such an element can produce a lower silver content photographic system with competitive speed and enhanced image quality.

The present invention also describes a method for imaging a photographic element, which element is described above. The tanning developer can be introduced in the coating solution, for example, in a 5 to 7 percent solution in the case of hydroquinone, hydroquinone/Phenidone TM (1-phenyl-3- pyrazolidone), hydroquinone/Metol TM (N-methyl-p-aminophenol sulfate), or mixtures thereof. At least two colored pigments or dyes, at least one of which is capable of changing color, are present in one or more layers.

Tanning developers such as Metol/hydroquinone, Phenidone/hydroquinone, and hydroquinone may be incorporated in at least one of the coated layers in whole or in part or in the processing solutions.

In this application:

"substantially free of hardener" or "a substantially unhardened gelatin layer" means a layer which exhibits hardness no greater than a gelatin layer containing 1 g of formaldehyde per kg of freshly coated gelatin;

"primed substrate" means a substrate that has been treated by ionizing radiation such as ultraviolet radiation, flame treatment, and preferably corona discharge treatment, and classical primer coatings which promote adherence of a coating layer to a substrate, such as polyvinylidene chloride and chlorinated phenols; and "colloidal silver" means a dispersion of silver metal in unhardened gelatin.

The present invention also provides a method of producing on a single coated sheet one or preferably two or more colors. Concealed within the element after the primary color is developed is an additional color which may be enhanced totally or locally with the application of a chemical treatment. This provides an option of utilizing the primary color singly, the secondary color or colors totally or a combination of both, producing two or more color artwork. This provides an advantage over the usual "black only" system whereas it is now possible to produce a primary black color and bring out in selected areas an additional color or colors to highlight the original. In the case of engineering drawings, specific areas such as titles or code numbers could be colored or complete areas of plumbing or electrical layout could be completed in individual colors. These elements may also contain UV absorbers allowing the colors to be used in conventional modes of producing contact negatives or positives.

DETAILED DESCRIPTION

The present invention provides a tannable photographic element which is a layered structure comprising in sequence a. an opaque, translucent, or transparent optionally primed base support;

b. optionally, a subbing layer comprising substantially unhardened gelatin coated over said base support at a coating weight of up to 1.0 g/m$^2$;

c. in either order (or combined into a unitary layer)

(1) a layer comprising colloidal silver having in the range of 0.05 to 1.5 g of Ag/m$^2$, and (2) a layer comprising light-sensitive silver halide emulsion in gelatin substantially free of hardener, at least one colored pigment or dye that absorbs radiation in the range of 300 to 1000 nm being dispersed in at least one of the colloidal silver and the light-sensitive layers in sufficient quantity to provide reflection or transmission optical density in the range of 1.0 to 5.0, preferably 1.0 to 4.0;

d. optionally, a protective topcoat layer comprising substantially unhardened gelatin;

e. optionally, in the range of 0.02 to 0.30 g/m$^2$ of a non-diffusable hydroquinione compound in at least one of the topcoat layer, the colloidal silver layer, or the light-sensitive layer;

f. optionally, a tanning developer in at least one of the light-sensitive layer, the colloidal silver layer, or the topcoat layer;

the total silver in said layer of light-sensitive emulsion and said colloidal silver layer being present in a quantity in the range of 0.5 $g/m^2$ to 5 $g/m^2$ and the gelatin of said emulsion layer being present in a quantity so as to provide a total silver/total gelatin weight ratio of less than 1.50, and if the tanning developer is present in at least one coated layer, then the total gelatin/total tanning developer weight ratio is in the range of 5 to 25, preferably 12 to 18;

the element being developable in an aqueous tanning activator which may contain all or part of a tanning developer sufficient to render the gelatin water-insoluble after development comprising an alkaline solution having a pH of at least 9.5, and followed by a wash-off procedure for removing undeveloped portions of the gelatin-containing layers to provide a first or primary color (black or any color, preferably black), and optionally followed by a chemical treatment to produce at least one additional color.

A preferred embodiment of the present invention provides a photographic element for tanning development which is a layered structure comprising in sequence a primed base support, a layer of unhardened gelatin subbing, a layer of colloidal silver, a layer of sensitized silver halide emulsion in gelatin free of hardener containing a tanning developer and at least one colored pigment or dye dispersed therein which absorbs radiation, and a protective layer of gelatin containing an antioxident agent. Alternatively, the antioxidant may be placed in the emulsion-containing layer. After exposure to suitable radiation (in the range of 300 to 1000 nm) and upon development in a tanning activator, the material is then subjected to a wash-off procedure for removing unexposed portions of the gelatin layer. The black image may then be subjected in whole or in part to a bleach-fix solution (reducing solution for silver) (Kodak TM Ektaprint TM 2 Bleach-Fix (EP-2 TM) CAT. 121638) in which areas a colored image will appear depending on the type of pigment employed or the length of time a reducing agent is applied.

In another embodiment, two or more pigments or dyes may be incorporated in any of the layers. On development a combination of the two or more pigments or dyes will be visible as the image. Treatment with a material to chemically alter one or more of the pigments or dyes in selected areas can be applied (see Examples 5 and 6).

In a further embodiment, as will be appreciated by those skilled in the art, the colloidal silver layer and the light-sensitive layer may be combined in a unitary layer. It is advantageous to use one or more pigments or dyes which do not absorb radiation in the wavelength range to which the silver halide is sensitized. It may be necessary to reduce the amount of colloidal silver in the layer to allow sufficient exposure of the silver halide present.

The base support upon which the emulsion is spread preferably is free of hardened gelatin and preferably contains a layer of unhardened gelatin subbing having a coating weight less than 0.3 $g/m^2$ and may be flexible or rigid and may be opaque, translucent, or transparent. When the support is opaque or translucent, preferably the support is resin coated paper, e.g., RC paper type 700-30 (Schoeller Technical Papers, Inc.). The support can be prepared with an unhardened gelatin subbing layer.

Opaque, translucent, or transparent supports used in this invention include strippable papers such as RC Paper grade MIS, lot 6737 (Schoeller Technical Papers, Inc., Pulaski, N.Y.) and originally opaque supports such as papers and opaque films prepared by incorporating a pigment such as titanium oxide, etc., in transparent films, plastic films the surfaces of which have been treated by the method described in Japanese Pat. Publication No. 19068/72, and papers, and films made, for example, of plastic which has been rendered completely light shielding by addition thereto of carbon black or dye, etc. Typical examples of flexible supports are those ordinarily employed for photographic materials, such as polyester, matte polyester (engineering drafting film), cellulose nitrate films, cellulose acetate films, cellulose acetate butyrate films, cellulose acetate propionate films, polystyrene films, polyethylene terephthalate films, polycarbonate films, laminates of these films, thin glass sheets, baryta-coated papers, papers laminated with a polymer of an α-olefin having 2 to 10 carbon atoms such as an α-polyolefin polymer, in particular, polyethylene, polypropylene or an ethylene-butene copolymer, and plastic films having improved adhesion to other polymers and improved printability by roughening the surfaces thereof as described in the above-mentioned Japanese Pat. Publication. Examples of rigid base supports include thick translucent layers of polyvinyl chloride which may be rendered light shielding. For purposes of adhesion the base can be primed. Base supports can be treated with ionizing radiation (preferably corona treatment). In some cases it may be useful to employ classical primer coatings as are known in the art, which preferably is a coating of polyvinylidene chloride.

As has previously been described in U.S. Pat. No. 4,427,757 the base support can contain either an extremely thin gelatin subbing layer substantially free of hardener or no subbing at all on a base that has been primed, instead of the conventional hardened gelatin subbing on the base, and provides superior image quality and low minimum density while maintaining excellent emulsion adhesion characteristics. As mentioned above, it is known in the art to use a hardened gelatin subbing layer between the base support and the gelatin silver halide layer. However, in tannable systems, subbing with hardener produces overall fog or background haze, leading to poor wash-off of the tanned image. The subbing layer of the present invention, which underlies the silver halide emulsion and which is substantially free of hardened gelatin, also contributes to greatly improved aging characteristics of the element. The unhardened gelatin subbing is an extremely thin layer, i.e., it has a coating weight of less than 0.3 $g/m^2$, preferably it is between 0.15 and 0.25 $g/m^2$, and adds no measurable thickness to the resulting gelatin resist. A primed base support with or without a subbing layer of unhardened gelation results in excellent adhesion of the photosensitive layer to the support, superior image quality, low minimum density, and provides a photographic element with improved aging properties. As already mentioned, use of gelatin subbing, with gelatin being unhardened, is optional. Satisfactory and even excellent results are achieved by coating the silver emulsion directly on a base support that has been treated with ionizing radiation, as mentioned above.

A colloidal silver dispersion can be prepared by any method known in the art such as is disclosed in P. Glafklides, "Photographic Chemistry", Fountain Press, London (1958), p. 568 and in U.S. Pat. No. 2,921,914, Example 1. As is known in the art, colloidal silver can provide a black, brown, blue, or yellow image depending on particle size. Typically, silver nitrate, dextrin, gelatin, and water are stirred together, digested and then chilled. In the present invention, the colloidal silver dispersion, when coated, contains in the range of 0.05 to 1.5 g/m$^2$ of silver, preferably 0.25 to 1.5 g/m$^2$, and most preferably 0.25 to 0.8 g/m$^2$. The coated, dried, colloidal silver layer has a thickness in the range of 0.5 to 5.0 micrometers, preferably 1.0 to 3.0 micrometers.

The present invention relates even more preferably to a photographic element as heretofore described, in which the silver halide emulsion includes silver chloride, bromide, bromochlorides, iodochlorobromides, chlorobromides, or iodobromides, or mixtures thereof. The emulsion is prepared by methods well known in the art and can be sensitized both chemically and spectrally in the manner described in G. F. Duffin, "Photographic Emulsion Chemistry", Focal Press, New York (1966) and P. Glafkides, "Photographic Chemistry", Fountain Press, London (1958). The present invention envisions varying the composition of the photosensitive emulsion so as to optimize the photospeed for the application intended, as for example in projection speed and contact films.

The photographic silver halide emulsions used in this invention may be spectrally sensitized or supersensitized, if desired, using cyanine dyes such as at least one of cyanine, merocyanine, carbocyanine, etc. or as a combination of them with styryl dyes, etc. These dye sensitization techniques are will known and are described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, West German Pat. Application (OLS) Nos. 2,030,326 and 2,121,780, Japanese Patent Publication Nos. 4936/68, 14030/69 and 10773/68, U.S. Pat. Nos. 3,511,664, 3,552,052, 3,527,641, 3,615,613, 3,615,632, 3,617,295, 3,635,721 and 3,694,217 and British Pat. Nos. 1,137,580 and 1,216,203. These techniques are selected depending on the wavelength region, sensitivity, etc. and the purposes and uses of the phototraphic materials.

Spectral sensitizers in the range of 0.0001 to 0.1 g/m$^2$, preferably 0.0004 to 0.05 g/m$^2$, include, as already mentioned, not only conventional spectral sensitizers within the visible range, i.e. 300 to 700 nm, but also supersensitizers and longer wavelength sensitizers and combinations thereof which extend the range into the infrared region of the spectrum, e.g., from 300 up to 1000 nm, preferably up to 900 nm, and most preferably from 350 up to 850 nm. For example, the emulsion can be sensitized to blue-green radiation in the range of 470 to 560 nm, to red radiation in the range of 610 to 690 nm, or to infrared radiation in the range of 780 to 850 nm.

Generally, any pigment or dye useful in photography or photographic emulsions, so long as it will not permanently obscure a secondary color to be revealed, is useful in the present invention. Such a pigment or dye should not be diffusable in the gelatin layer even when swollen with an aqueous solution, and in itself should not be reactive with the photographic emulsion to give adverse effects such as fogging or desensitizing, and preferably has low solubility in the development process. Dyes or pigments can be introduced by methods and with surface active agents which are compatible with the silver halide emulsion used (those surface active agents are known in the art as dispersing agents, and are useful whether they be anionic, non-ionic, cationic or amphoteric, such as those described in Schwarty et al., *Surface Active Agents and Detergents,* Vol I and II, Interscience Publishers, and in U.S. Pat. Nos. 2,992,108, 3,068,191, 3,201,252, 3,165,409, in French Pat. Nos. 1,556,240 and 1,497,930, in British Pat. Nos. 580,504, 985,483 and 1,274,523, and in U.S. Pat. Nos. 3,762,025 and 3,860,425), and should be compatible with the method for obtaining a colored relief image according to the present invention.

Certain pigments with particle size less than 1.0 micron diameter, preferably less than 0.5 micron diameter, and having optical absorption in the range of 350 to 700 nm and which form aqueous dispersions are particularly useful, such as Flexonil Blue® AN No. 15-1032, Colonyl Yellow FGL-A No. 11-3011, and Colonyl Red FGR No. 13-3054 (American Hoechst, Elk Grove Village, IL); Phthalo Blue WD 2228, Organic Scarlet WD 2657, Deep Organic Red WD 2673, Phthalo Green WD 2744 (Daniel Products Co. Jersey City, NJ), dyes such as Parazol Yellow 2GCD, Drimarene Dark Blue X-2BL, Drimarene Scarlet R-3G (Sandoz Colors and Chemicals, East Hanover, NJ) and a cyan dye as disclosed in U.S. Pat. No. 2,612,448. These aqueous dispersions are prepared by suspending water-insoluble pigments in water as is known in the art. Mixtures of pigments or dyes which produce black or near-black images are not advantageous in the present invention.

The present invention envisions embodiments wherein some of the pigment or dye (i.e., up to 30 weight percent, preferably up to 20 weight percent, of the total pigment present) is coated in a separate layer over the silver halide emulsion optionally containing the tanning developer, although preferably the pigment is dispersed in the light-sensitive silver halide layer. Pigment or dye in the light-sensitive layer range in amount from 0.1 to 4.0 g/m$^2$, preferably 0.2 to 1.0 g/m$^2$ on opaque, translucent, and transparent base supports.

The choice of the tanning development agent has not been found to be as critical as described in the aforesaid U.S. Pat. No. 3,364,024, in the sense that even catechol was found useful for the purposes of the present invention. At least one hydroquinone, diffusible or non-diffusible, and preferably diffusible, was found to be preferable because of its lower cost and its wider range of activity combined with the greater stability of its oxidation product.

"Tanning agent" as used herein means at least one compound selected from hydroquinones, hydroquinones/Phenidone TM (1-phenyl-3-pyrazolidone) and hydroquinones/metol (N-methyl-p-aminophenol sulfate). As noted above, a tanning developer is present in at least one of the emulsion layer, colloidal silver layer, the topcoat layer, or the activator. Preferably the tanning developer is a combination of hydroquinone and Phenidone having a weight ratio of hydroquinone to Phenidone of 16.5:1 to 1.2:1 and preferably it is 7.7:1. In studying the optimum tanning agent quantity, it has been found that excessive quantities lead to partial tanning even of the non-exposed zones. In the case of graphic arts applications, this leads to a smaller exposure range and a reduction in image quality.

A topcoat of substantially unhardened gelatin is useful to protect the silver halide emulsion from abrasion. It has been found that certain nondiffusible antioxidants, including nondiffusible hydroquinones improve the image quality and optionally are present in the topcoat layer in amounts in the range of 0.02 to 0.30 g/m$^2$ for substituted hydroquinones. Substituted hydroquinone can be optionally included in the silver halide emulsion layer. This non-diffusible hydroquinone is in addition to the hydroquinone/Phenidone agent incorporated in the silver halide emulsion layer.

In the present invention when the tanning developer is included in the photographic element, the activator used is known in the art and typically comprises an aqueous solution of sodium or potassium carbonate and sodium or potassium sulfate. For example, the activator solution may contain 12 weight percent $Na_2SO_4$ and 2 weight percent $Na_2CO_3$ in water, and sufficient $NaHCO_3$ is added to adjust the pH to 10.0. In constructions where the tanning developer is included in whole or in part in the developer solution, the activator solution may contain, for example, 1 weight percent hydroquinone, 9 weight percent potassium carbonate and 2.5 weight percent potassium hydroxide in water.

As is known in the art, one or more backing layers may be applied to the base support, e.g., an anti-curl layer, anti-static layer, and/or an antihalation layer. When a transparent base is used, it may be desirable, particularly when the optical density of the colloidal silver layer is less than about 1.0 to utilize an antihalation layer of high density which can be applied to the back side of the support.

Also, the present invention provides a method for obtaining a primary black or colored image in a photographic element comprising a primed support which optionally has a subbing layer substantially free of hardener thereon, and spread thereover in either order a colloidal silver dispersion layer and a photographic emulsion layer containing silver halide in gelatin substantially free of hardener and optionally comprising a tanning developer and, as described above, at least one colored pigment dispersed therein, said method consisting of exposing said element to radiation in the visible range and/or infrared range of 300 to 1000 nm, through the emulsion layer, or it may be exposed through the base, and causing it to be developed by the tanning developer included in the element or in an alkaline activator solution the alkaline activating solution comprising, e.g., sodium sulfate and sodium carbonate in aqueous solution having a pH of at least 9.5 to provide an image, and drying the resulting imaged element. Development provides a black or colored image. To produce a second color in selected areas of the image any bleach-fix solution (e.g., Kodak TM EP2 TM) is applied for a time sufficient to bleach the black or colored image (colloidal silver) and expose the pigment below. Normally, the bleach time is in the range of 10 to 30 seconds, but it can be in the range of instantaneous to 5 minutes. The bleach-fix can be applied by a pen, swab, or by immersion of selected areas or the entire image in the chemical treatment. For example, a refillable felt-tipped pen with Kodak EP2 solution, or a silver image correction pen (A. I. Friedman Inc., 25 West 45 St., NYC, NY 10036) can be used to produce a second color.

Elements of the present invention find use particularly in projection speed film, camera speed paper and film, contact speed paper and film including color proofing, strippable paper for backlit applications, and laser scanning or proofing exposure techniques, commercial graphics where two color posters can be produced on a single coated sheet eliminating image transfer, and lamination or die cutting.

Objects and advantages of this invention are further illustrated by the following examples, but the particular materials and amounts thereof recited in these examples, as well as other conditions and details, should not be construed to unduly limit this invention.

EXAMPLE 1

A layered coating consisting of a colloidal silver layer (A), protective underlayer (B), light sensitive layer (C), and antiabrasion top layer (D), was coated over a base support, i.e., Schoeller strippable 13 micrometers (0.5 mil) polyester paper No. 46-57-2. The emulsion was prepared as is known in the art containing 64 mole percent chloride and 36 mole percent bromide employing a sulphur/gold digestion procedure for improving the reciprocity characteristics of very short exposure times and has a mean grain size of 0.28 micrometer and was sensitized to a peak energy emission at about 488 nm.

COATING LAYER A

| | |
|---|---|
| inert gelatin (Rousselot) | 0.4573 g/sq meter |
| 4-chloro-3-methylphenyl | 0.0080 g/sq meter |
| Cosmopon TM LM solution | 0.0034 g/sq meter |
| colloidal silver dispersion | 0.216 g/sq meter of silver |
| sodium hydrozide | as needed for pH adjustment to 6.5 |

A colloidal silver layer, prepared as in U.S. Pat. No. 2,921,914, Example 1, was coated to a silver density of 0.8 g/m$^2$ and protective layer B described below was coated simultaneously forming the first pass of the system.

COATING LAYER B

| | |
|---|---|
| inert gelatin (Rousselot) | 0.3875 g/sq meter |
| 4-chloro-3-methylphenol | 0.0084 g/sq meter |
| sodium dioctyl-sulfosuccinate | 0.2957 g/sq meter |
| Cosmopon TM LM solution (sodium salt of alkyl-sulfosuccinate La Tessilechimica S.P.A. Bergamo, Italy 24100) | 0.0216 g/sq meter |

COATING LAYER C

| | |
|---|---|
| sensitized emulsion** | 0.4698 g Ag/sq meter |
| inert gelatin (Rousselot) | 1.1848 g/sq meter |
| 4-chloro-3-methylphenol | 0.0080 g/sq meter |
| dispersed yellow pigment+ | 0.2817 g/sq meter |
| 7-hydroxy-3-methyl-2-methylthio-5-triazolo [1.5-a] pyrimidine) | 0.0083 g/sq meter |
| surfactant (Triton TM X-200, Rohm and Haas Co., Philadelphia, PA) | 0.2707 g/sq meter |
| 5-nitroindazole | 0.00012 g/sq meter |
| 2,5-diisooctylhydroquinone | 0.1460 g/sq meter |
| hydroquinone | 0.0963 g/sq meter |
| phenidone | 0.0124 g/sq meter |
| citric acid | as needed for pH 5.5 |

-continued

| | adjustment |
|---|---|

**A silver halide emulsion containing 60 g of gelatin and 1.1 moles of silver chlorobromide (30 mole percent silver chloride and 70 mole percent silver bromide) in 760 g of water was prepared. The mean grain size of the silver chlorobromide grains was 0.4 micrometer. After removing the soluble salt by-product in a conventional manner, the silver halide emulsion was chemically sensitized by the addition of sodium thiosulfate.

+Dispersed pigment preparation:

In deionized $H_2O$ 19.0 g surfactant Tamol TM SN (Rohm and Haas Co.) were dissolved and 90.0 g methanol was added. With stirring 192.0 g yellow benzidine pigment (Hercules Magestic Yellow X 2600 Hercules, Inc., Wilmington, DE) and 240 g gelatin were added. With a two roll mill set for a 10 mil gap and using cold water to cool the cylinders 80 passes were made through the mill. 36 g of the milled pigments were added to 160 g deionized $H_2O$ and 20 ml of a 1 weight percent Triton X-200 surfactant solution in water; the mixture was stirred at room temperature for about 3 hours, heated to 60° C. for 30 minutes, filtered and refrigerated. Two additional pigments employed were Cyan Phthalo Blue (Dupont BT2840) and Magenta Bonadur Red (American Cyanamide 20-6470) both having acceptable results.

COATING LAYER D

| | |
|---|---|
| inert gelatin (Rousselot) | 0.4802 g/sq meter |
| 4-chloro-3-methylphenol | 0.0080 g/sq meter |
| surfactant (Maprofix TM 563, Onyx Chemical, Jersey City, NJ) | 0.0028 g/sq meter |
| lauric acid diethanolamine | 0.0161 g/sq meter |

Layers C and D were simultaneously coated on top of the previously coated layers A and B. With the correct coating properties, all four layers could be coated at the same time. It is to be understood that the above coating solutons can be coated on all types of base supports producing the primary black color and containing at least one other color.

The coated material was exposed on a conventional graphic arts contact frame utilizing a 100 watt tungsten point light source at 117 lumens output, 163 cm distance from the source, for 10 sec. Upon development in a tanning activator for 32 sec. at 32° C. (90° F.) containing an alkaline solution having 12 weight percent sodium sulfate, 2 weight percent sodium carbonate, and sufficient sodium bicarbonate to adjust the pH to 10.1 in a one liter solution, and followed by a wash-off procedure in 41° C. (105° F.) warm water for about 65 seconds to remove unexposed portions of the colored gelatin layer, a black edgesharp image was produced. The material was then treated in localized areas with Kodak EP-2 bleach-fix revealing a second color, thus producing a two color image.

As expected, the undercoating of colloidal silver served as an antihalation layer. Thus, very sharp line and halftone images were obtained even with very transparent pigments.

In all cases of this example, very bright samples of yellow, magenta and cyan were brought out in the border area of the printed test producing colorful two color posters. Also the material being coated on a strippable membrane could be transferred with an adhesive layer to other colored supports or could be backlighted for other special colored effects.

EXAMPLE 2

Photographic elements were prepared and developed using the method and formulations of EXAMPLE 1, except that coating layer B was omitted and the colored pigments used in layer C were individually replaced with aqueous pigment dispersions of Flexonil Blue AN No. 15-1032, Colonyl Yellow FGL-A No. 11-3011 and Colonyl Red No. 13-3054 (American Hoechst, Elk Grove Village, IL) and the emulsion was substituted with a silver iodobromide emulsion (92.6 mole percent silver bromide and 7.4 mole percent silver iodide) as known in the art for high speed radiation sensitivity.

The coated materials were exposed on a conventional graphic arts contact frame utilizing a professional electronic flash Auto 611 Thyristar TM from Sunpak TM, 163 cm distance from the source.

After processing, the black image samples each containing 0.263 grams per meter square of the individual colors were subjected to Kodak EP-2 bleach-fix in localized areas giving edgesharp negatives of the original in two colors.

EXAMPLE 3

A highly sensitive optically-sensitized layer C as described in EXAMPLE 2 was prepared, exposed, and developed according to EXAMPLE 2 with the exception that the aqueous pigment dispersions were replaced with the dyes Parazol Yellow 2GCD, Drimarene Dark Blue X-2BL, Drimarine Scarlet R-3G, (Sandoz Colors and Chemicals, East Hanover, NJ 07936) and a cyan dye disclosed in U.S. Pat. No. 2,612,448 with the following structure:

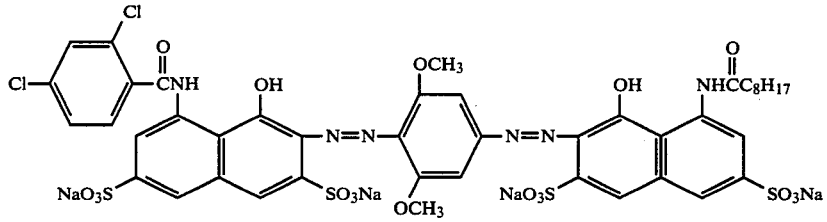

Three percent W/W of the above dyes were prepared in deionized $H_2O$ and added to the coating layer at the rate of 0.2486 grams per meter square. The results were very similar to those of EXAMPLE 1 and clearly illustrate the use of pH stable dyes as one alternative in the present invention.

EXAMPLE 4

Four photographic elements were prepared and developed using the method and formulation of EXAMPLE 1, exposure of EXAMPLE 2, with the exception that coating layer B was omitted and the amounts of colloidal silver utilized were 0.080 g/m$^2$, 0.216 g/m$^2$, 0.324 g/m$^2$, and 0.432 g/m$^2$. The resulting colloidal silver densities were 0.70, 0.98, 1.35, and 1.80 respectively and all samples appeared to be black before a bleach solution was applied. Coating layer A alone was coated to an optical density of 3.5 using 0.8 grams of colloidal silver per meter squared. All materials exhibited the same good quality after processing as in EXAMPLE 1.

EXAMPLE 5

Photographic elements were prepared, exposed and developed using the method and formulation of EXAMPLE 1 with the exception that two colored pigments (yellow and magenta) were added to the coating layer C. After processing, the black element was exposed the Kodak EP-2 bleach-fix revealing an orange color and after prolonged exposure to the bleach-fix solution the magenta faded away and left only the yellow pigment thus producing three colors on one coated support base.

EXAMPLE 6

A photographic element was prepared and developed using the method and formulations of EXAMPLE 3 with the exception that a color changeable dye Parazol Yellow 2GCD (Sandoz Colors and Chemicals, East Hanover, NJ 0.7936) was utilized. After processing, a portion of the black element was exposed to Kodak EP-2 bleach-fix and revealed a yellow color. The yellow color was then treated with a Silver Image Correction Pen producing a red color on the yellow due to a pH change. The Silver Image Correction Pen treatment was also applied directly to the black image and produced a red colored image by bleaching the colloidal silver and exposing the yellow pigment; however, immediately the pH change turned the yellow color to red. The red color may then be reversed back to yellow or vice/versa depending on the pH of the bleaching solution used. By using this technology, a single sheet coating can produce three colors and can be coated on a strippable base, then laminated to another colored receiver producing multicolored artwork.

EXAMPLE 7

Photographic elements were prepared and developed using the methods and formulations of EXAMPLE 1, except that in Coating Layer C the pigment was replaced with Bonadur Red from EXAMPLE 1 and the sensitized negative emulsion was replaced with a positive emulsion**. The resulting positive images were treated in localized areas with a Silver Image Correction Pen which bleached the colloidal silver and revealed the red pigment. A positive two-color image material was produced.

** A silver halide emulsion containing 40 g of gelatin and 1.0 mole of silver iodobromide (3 mole percent silver iodide and 97 mole percent silver bromide) in 760 g of water was prepared. The mean grain size of the iodobromide grains was 0.25 micrometer. After removing the soluble salt by-product in a conventional manner, the silver halide emulsion was chemically sensitized and fogged by known means such as described in U.S. Pat. No. 3,062,651.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A tannable photographic element capable of providing a multi-colored image which is layered structure comprising a. a base support, and b. coated thereon in either order or in unitary layer, (1) a layer comprising colloidal silver having in the range of 0.05 to 1.5 g of Ag/m$^2$, and (2) a layer comprising a light-sensitive silver halide emulsion in gelatin substantially free of hardener, at least one colored pigment or colored dye that absorbs radiation in the range of 300 to 1000 nm in sufficient quantity to provide a reflection or transmission optical density in the range of 1.0 to 5.0, said colored pigment or colored dye being dispersed in at least one of the colloidal silver and the light-sensitive layers;

the total silver in said layer of light-sensitive emulsion and said colloidal silver layer being present in a quantity in the range of 0.5 g/m$^2$ to 5 g/m$^2$, and the gelatin of said emulsion layer being present in a quantity so as to provide a total silver/total gelatin weight ratio of less than 1.5.

2. The element according to claim 1 wherein said base support is primed.

3. The element according to claim 1 further comprising a subbing layer comprising substantially unhardened gelatin coated over said base support at a coating weight of less than 0.3 g/m$^2$.

4. The element according to claim 1 further comprising a protective topcoat layer comprising substantially unhardened gelatin.

5. The element according to claim 4 further comprising in the range of 0.02 to 0.3 g/m$^2$ of a non-diffusable hydroquinione compound in at least one of said colloidal silver layer, said light-sensitive layer, or said topcoat layer.

6. The element according to claim 4 further comprising a tanning developer in at least one of said light-sensitive layer, said colloidal silver layer, or said topcoat layer.

7. The element according to claim 6 wherein the total gelatin/total tanning developer weight ratio is in the range of 5 to 25.

8. The tannable photographic element according to claim 1 wherein said silver in said colloidal silver layer is present in the range of 0.3 to 1.5 g/m$^2$.

9. The photographic element according to claim 1 wherein said pigment or dye in said light-sensitive layer is present in the coating in an amount in the range of 0.1 to 4.0 g/m$^2$.

10. The photographic element according to claim 4 further comprising up to 30 weight percent of said at least one pigment or dye dispersed in said protective topcoat layer.

11. The photographic element according to claim 1 wherein said support is resin coated paper, clear or matte polyester, or clear or matte cellulose triacetate.

12. The photographic element according to claim 1 wherein said support is flexible, rigid, or strippable.

13. The photographic element according to claim 6 wherein said at least one tanning developer is selected from hydroquinones, hydroquinones/1-phenyl-3-pyrazolidone, and hydroquinones/N-methyl-p-aminophenol sulfate.

14. The photographic element according to claim 1 wherein said colored pigment or dye comprises at least two pigments or dyes.

15. The photographic element according to claim 1 which is capable of providing an engineering drawing.

16. The photographic element according to claim 1 which is a contact speed paper or film.

17. The photographic element according to claim 1 which is a camera speed paper or film.

18. The photographic element according to claim 1 which is phototypesetting paper or film.

19. The photographic element according to claim 1 which is a laser scanner film.

20. The photographic element according to claim 1 wherein said element is a laser scanner proofing film on a transparent base.

21. A method for obtaining a colored image comprising the steps of:

(a) providing the tannable photographic element which is a layered structure comprising: a base support, and coated thereon in either order or in a unitary layer (1) a layer comprising colloidal silver having in the range of 0.05 to 1.5 g of $Ag/m^2$, and (2) a layer comprising a light-sensitive silver halide emulsion in gelatin substantially free of hardener, at least one colored pigment or colored dye that absorbs radiation in the range of 300 to 1000 nm in sufficient quantity to provide a reflection or transmission optical density in the range of 1.0 to 5.0, said colored pigment or colored dye being dispersed in at least one of the colloidal silver and the light-sensitive layers;

the total silver in said layer of light-sensitive emulsion and said colloidal silver layer being present in a quantity in the range of 0.5 $g/m^2$ to 5 $g/m^2$, and the gelatin of said emulsion layer being present in a quantity so as to provide a total silver/total gelatin weight ratio of less than 1.5, (b) exposing said element to radiation in the range of 300 to 1000 nanometers, (c) contacting the exposed element with an aqueous activator solution having a pH of at least 9.5, (d) removing unexposed portions of the coated gelatin-containing layers to provide an image, (e) drying the resulting primary color-imaged element, (f) subjecting said resulting primary color image in whole or in part to a bleach-fix solution for a time sufficient to reduce said primary color image to a colorless or changed form and allow a secondary colored image to become visible, and (g) drying the resulting colored imaged element.

* * * * *